United States Patent [19]

Smith, Jr. et al.

[11] Patent Number: 5,017,779

[45] Date of Patent: May 21, 1991

[54] REAL TIME FARADAY SPECTROMETER

[75] Inventors: Tommy E. Smith, Jr., Fremont, Calif.; Kenneth W. Struve, Albuquerque, N. Mex.; Nicholas J. Colella, Livermore, Calif.

[73] Assignee: The United States of America as represented by the United States Department of Energy, Washington, D.C.

[21] Appl. No.: 516,402

[22] Filed: Apr. 30, 1990

[51] Int. Cl.[5] ..... H01J 49/00

[52] U.S. Cl. ..... 250/283; 250/299; 250/305

[58] Field of Search ..... 250/283, 297, 299, 305, 250/397, 251

[56] References Cited

U.S. PATENT DOCUMENTS

| | | | |
|---|---|---|---|
| 3,240,931 | 3/1966 | Wiley et al. | 250/299 |
| 3,293,429 | 12/1966 | LeBoutet et al. | 250/299 |
| 3,648,047 | 3/1972 | Bushman | 250/299 |
| 3,812,354 | 5/1974 | Walter | 250/299 |
| 3,953,731 | 4/1976 | Forsen | 250/283 |
| 4,184,073 | 1/1980 | Gilbert | 250/305 |
| 4,208,582 | 6/1980 | Arnush et al. | 250/291 |
| 4,473,748 | 9/1984 | Konagai et al. | 250/299 |

OTHER PUBLICATIONS

"Energy Measurements of the Electron Beam Beyond the Paladin Wiggler", Orzechowski et al., *11th Conference on Free Electron Lasers*, Aug. 1989.

*Primary Examiner*—Bruce C. Anderson

*Attorney, Agent, or Firm*—Michael Lee; L. E. Carnahan; William R. Moser

[57] ABSTRACT

This invention uses a dipole magnet to bend the path of a charged particle beam. As the deflected particles exit the magnet, they are spatially dispersed in the bend-plane of the magnet according to their respective momenta and pass to a plurality of chambers having Faraday probes positioned therein. Both the current and energy distribution of the particles is then determined by the non-intersecting Faraday probes located along the chambers. The Faraday probes are magnetically isolated from each other by thin metal walls of the chambers, effectively providing real time current-versus-energy particle measurements.

20 Claims, 5 Drawing Sheets

REAL TIME FARADAY SPECTROMETER

The United States Government has rights in this invention pursuant to Contract No. W-7405-ENG-48 between the U.S. Department of Energy and the University of Calif., for the operation of Lawrence Livermore National Laboratory.

BACKGROUND OF THE INVENTION

The invention relates to a charged particle beam spectrometer.

Classical electrodynamics show that a charged particle moving with a velocity through a magnetic field oriented at right angles to the direction of a component of the particle's velocity will be angularly deflected by an amount dependent on the particle's mass, charge and velocity, as well as the strength of the magnetic field. If the charged particles in a beam all have the same mass and charge and all experience the same magnetic field, any differences in bend angle may be attributed to a difference in velocity (kinetic energy) of the particles. In such an arrangement, the greater the particle's velocity, the less its bend angle will be. Examples of equally charged particle beams include electron beams, proton beams, and ion beams.

Most electron energy spectrometers currently in use utilize a bending magnet to achieve primary separation of the various particle energy components and then direct the angularly separated beam to a beam detector. Measurement of the beams current (the number of charges passing a point in a second) in a conventional charged particle beam spectrometer is typically accomplished in one of two ways; foil-light emissions or Faraday cups.

In spectrometers utilizing foil-light emissions for beam current detection, a thin foil is placed transverse to the beam path at some point downstream of the magnet. As the particles intersect the foil, light is created from the particle collisions with the foil atoms. The amount of light created is a function of the number of particles involved in the collisions, and thus the beam current can be inferred from the light intensity profile along the foil. An advantage of this method is that it provides a continuous and instantaneous energy spectrum of the beam. That is, the divergence of the beam envelope in the momentum-dispersed direction defines the beam's entire energy spectrum, and as long as the foil is continuous where it interacts with the beam, the energy spectrum displayed by the foil will also be continuous. A disadvantage of this method is that beam current is inferred from foil light emissions only, and since the physics of these interactions can be quite complex, the values derived can be in error.

Another way commonly used for determining the current of each spectral component of the beam is by using a Faraday cup. Faraday cups use a conductor as a charge collector. Charged particles are directed to the charge collector, which captures the charged particles. The number of charged particles captured by the charge collector is measured with respect to time by a Faraday cup. A further explanation of Faraday cups is given by D. Pellinen in "A High Current, Subnanosecond Response Faraday Cup," in The Review of Scientific Instruments, Vol. 41, Number 9, pp 1347–1348, incorporated by reference. While the Faraday cup has the advantage of providing very accurate current readings, in order to give energy information it must be moved across the beam path in the energy-dispersed direction, since the Faraday cup can measure the current at only one location at a time. This will yield very accurate energy data, but does not allow an instantaneous reading of the beam's current and energy distribution. Designs for arrays of Faraday Cups either do not withstand prolonged use, or require extensive shielding and collimation prohibiting the close placement of sensing regions of the Faraday cups. A further description of problems with Faraday Cups is described by T.P. Starke in "High Frequency Faraday Cup Array," in The Review Of Scientific Instruments, Volume 51, Number 11, pp 1473–1477. It should be noted that Faraday Cups are not Faraday probes described in the invention below.

In addition to the above limitations, because both Faraday cups and foils intersect the beam, both methods are limited to beams of relatively low currents. Higher current beams would thermally or structurally damage these detectors. The spectrometers described above have been adequate for many charged particle beam applications which require the analysis of essentially monoenergetic beams (energy variations of less than 5%), and frequently the currents involved are not high enough to cause thermal or structural damage to the intersecting medium.

Spectral analysis of high power charged particle beams or charged particle beams having a broad energy spectrum with energy variations of greater than 5%, such as the charged particle beams produced by high-power Free Electron Laser amplifiers require a particle beam diagnostic more robust than the existing detectors.

Free Electron Lasers utilize an undulating relativistic electron beam to amplify a laser beam. Because the kinetic energy of the electrons is converted into photons, the light amplification increases with beam current and energy. This also means that as the beam exits the undulator it can have widely-varying energy components, which depend on the efficiency of the energy conversion process.

SUMMARY OF THE INVENTION

It is an object of the invention to provide a charged particle beam spectrometer and detector which provides an instantaneous and accurate reading of the beam's current and energy distribution.

It is another object of the invention to provide a robust charged particle beam spectrometer and detector wherein the measured beam does not need to intersect the detection device.

It is another object of the invention to provide a charged particle beam spectrometer and detector which can accurately and instantaneously measure the current and energy distribution of a beam with a current as high as 10 kA and as much as a 30% energy variation and can be adapted to accept almost any combination of energy dispersion and current.

These and other objects of the invention will become readily apparent to those skilled in the art from the following description and accompanying drawings.

The invention uses a dipole magnet to bend the path of a charged particle beam. As the deflected particles exit the magnetic field of the dipole magnet, they are spatially dispersed in the bend-plane of the magnet according to their respective momenta. Both the current and energy distribution of the particles can be measured by the inventive apparatus, comprising a plurality of sensing loops located along the energy dispersed direction of the beam. The sensing loops, Faraday probes, are current loops which are magnetically isolated from each other by thin metal walls. By Faraday induction, the Faraday probes allow the measurement of current verses particle beam energy in real time.

DESCRIPTION OF THE PREFERRED EMBODIMENT

Figure 1:
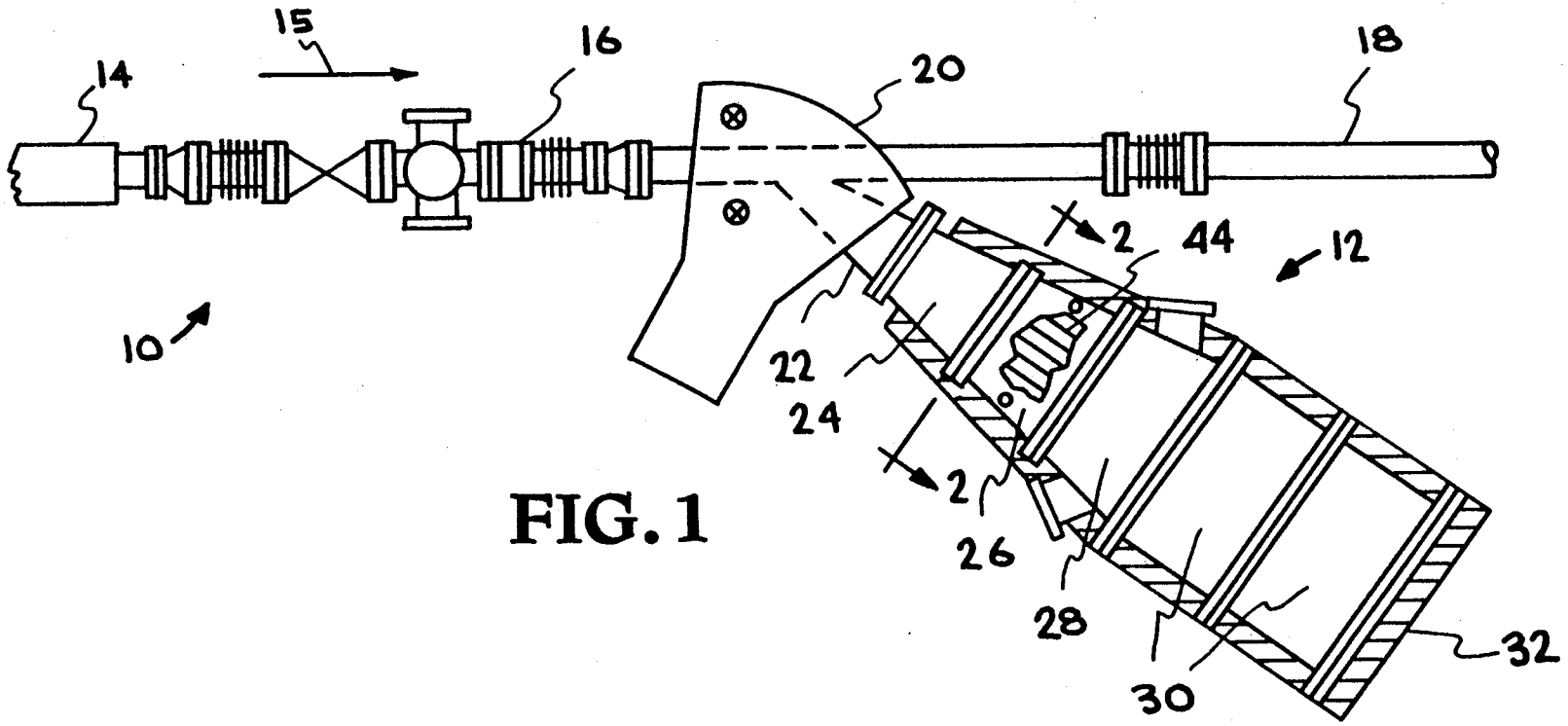
FIG. 1 is an illustration of part of a free electron laser employing a spectrometer which uses a preferred embodiment of the invention.

FIG. 1 is an illustration of part of a free electron laser 10 employing a preferred embodiment of the inventive beam spectrometer, shown generally at 12. The parts of the free electron laser 10 shown in FIG. 1 are the wiggler 14, charged particle beam piping components 16, and a laser beamline 18.

The spectrometer 12, comprises a bending magnet 20, a y-tube 22, a drift tube 24, the beam detector 26, a vacuum pump box 28, beam dumps 30, and a support stand 32. In operation the spectrometer 12 uses the bending magnet 20 to achieve primary angular separation of the various particles according to particle momentum and to direct the angularly separated particles toward the detector 26. The bending magnet 20 also separates the charged particles from a laser beam, directing the charged particle beam along a first branch of the y-tube 22 towards the drift tube 24 and allowing the laser beam to continue on a straight path down a second branch of the y-tube 22 towards the laser beam line 18. The charged particles passing through the first branch of the y-tube 22 enter the drift tube 24. As the particles pass along the length of the drift tube 24 the angular separations between particles of different momentum results in a greater spatial separation according to particle momentum. From the drift tube 24 the charged particle beam is directed to the beam detector 26. The beam detector 26 accurately measures the instantaneous energy or momentum distribution versus the current of the charged particle beam. The beam detector 26 attenuates very little of the charged particle beam, and therefore allows most of the energy of the charged particle beam to pass through a vacuum drift chamber 28 to beam dumps 30 where the particle beam is attenuated to remove the measured particles. The vacuum drift chamber 28 is the part of the spectrometer where the vacuum is provided for the spectrometer. The support stand 32 is a mechanically support for the spectrometer.

Figure 2:
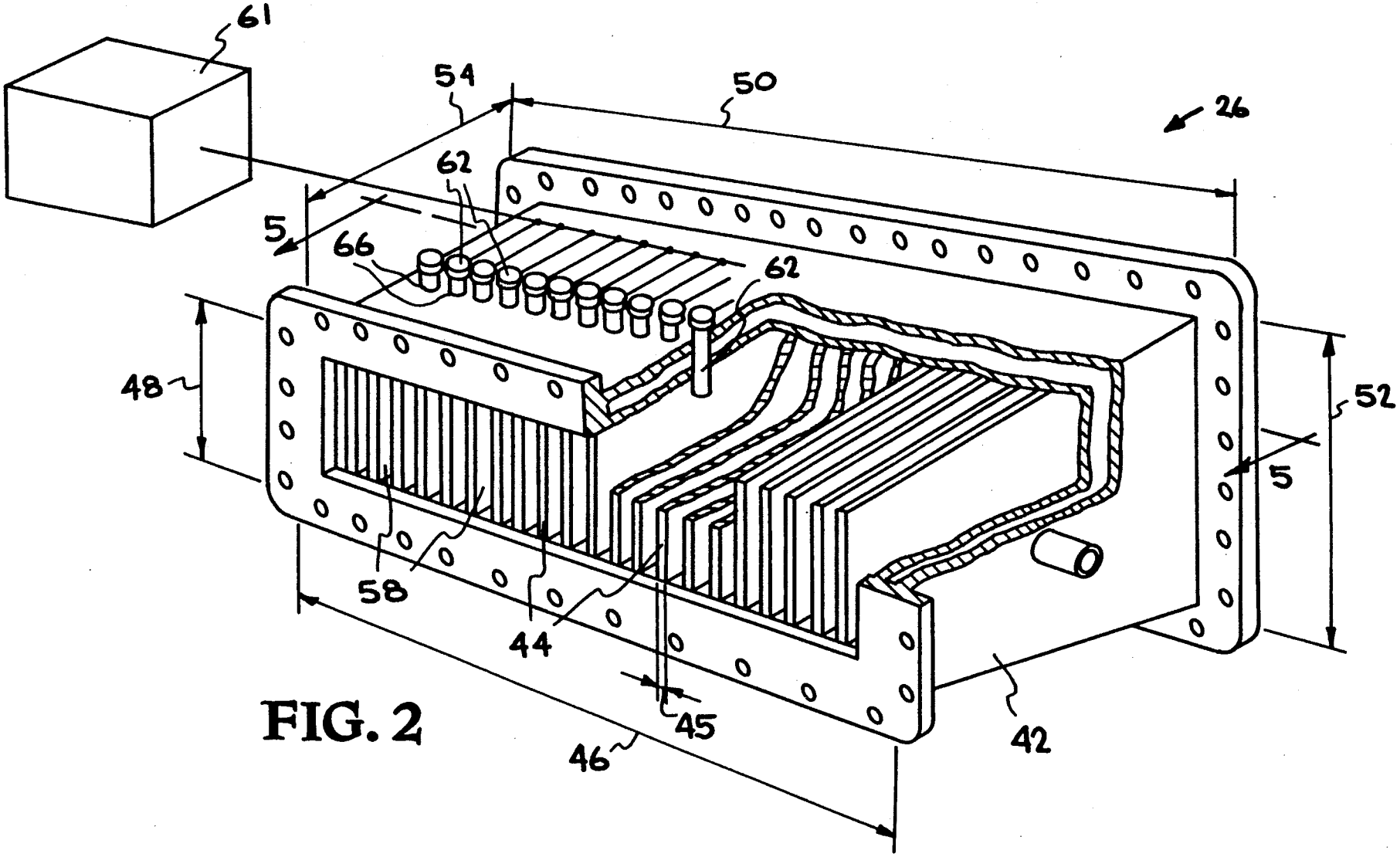
FIG. 2 is a cut away perspective view of a preferred embodiment of the invention along cut lines 2 shown in FIG. 1.

FIG. 2 is a cut away perspective drawing of the beam detector 26 along lines 2 of FIG. 1. In the preferred embodiment the beam detector 26 as shown in FIG. 2 is essentially a rectangular vacuum vessel, sized approximately 50% larger in both dimensions than the envelope of the beam transported through it. Because the beam diverges in both its width and height, the rectangle forming the detector's 26 front cross section is smaller than the one forming its rear cross section. Overall, the preferred embodiment has approximate dimensions: a width 46 of 28" and a height 48 of 8" at its front surface, and a width 50 of 37" and a height 52 of 9.5" at its rear surface, and an axial length 54 of 12". The width of the preferred embodiment of the detector 26 is subdivided into twenty-two compartments 58 by means of thin (1 mm thick) equally-spaced metal sheets 44 as illustrated in FIG. 2. The compartments 58 form a tunnel or tubular shape with a rectangular cross-section as shown. The metal sheets 44 are also illustrated in FIG. 1, but fewer sheets are shown, to allow a less cluttered illustration. The thickness 45 of each metal sheet 44 was made thin enough to minimize the number of beam particles intercepted by each metal sheet 44, yet thick enough to prevent magnetic fields caused by the charged particle beam from diffusing through the metal sheets 44 during the duration of the pulse. These sheets 44 form separation walls which run the length of the compartments 58 as shown. For current detection, each compartment 58 has at least one Faraday probe 62. In the preferred embodiment, each compartment 58 has two Faraday probes 62. The probes 62 are located at the top and bottom of each compartment 58. The probes 62 are inserted into the compartments 58 through probe ports 66. The output of the Faraday probes 62 is sent to a conventional electronic data acquisition and display apparatus 61, which processes the information.

Figure 3:
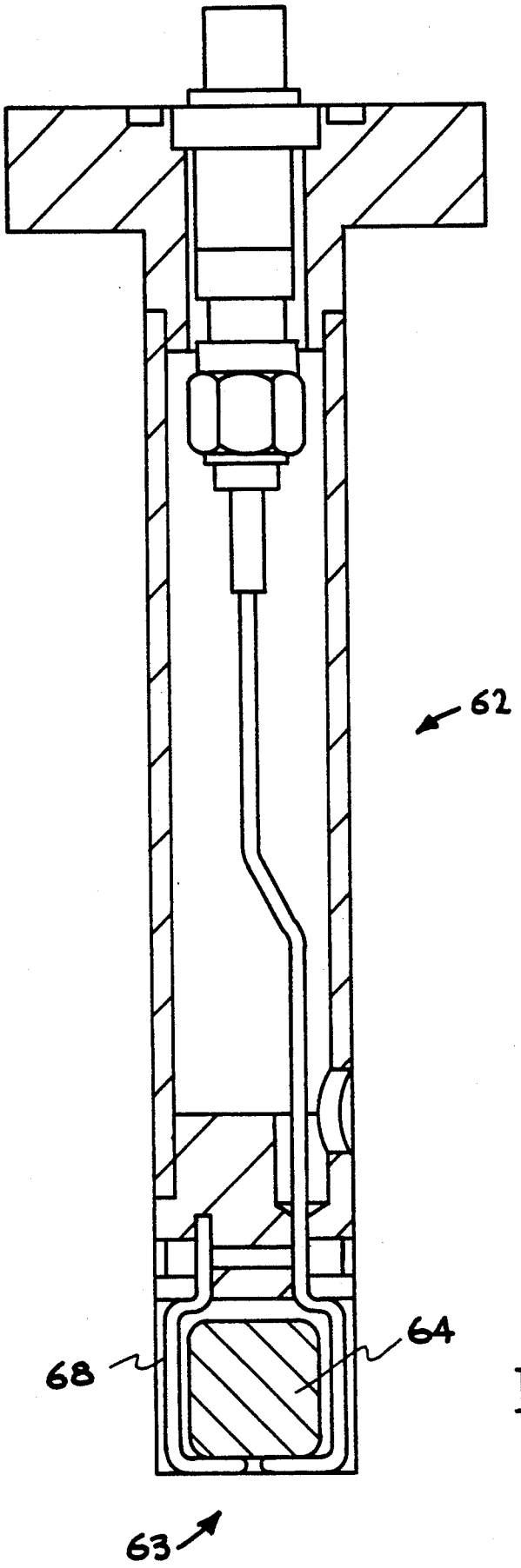
FIG. 3 is an illustration of a Faraday probe used in the preferred embodiment of the invention shown in FIG. 2.

FIG. 3 is an illustration of a cross-section of a Faraday probe 62 used in the preferred embodiment of the invention. Each probe 62 has a detection tip 63, which in the preferred embodiment comprises a current loop 68 surrounding a ferrite core 64. The loops 68 in the Faraday probes 62 provide an induced voltage signal that is passively amplified by a high-permeability ferrite core 64 located in the center of the Faraday probe's current loop 68. Preferably the tip of an upper probe 62 is located approximately 1" below the extreme upper surface of the chamber, and the tip 63 of a lower probe 62 is located approximately 1" above the extreme lower surface of the chamber. These locations assure that the detector is far enough away from the beam envelope so as not to be intercepted by the beam, yet close enough to adequately sense the transient magnetic field produced by the beam.

Figure 4:
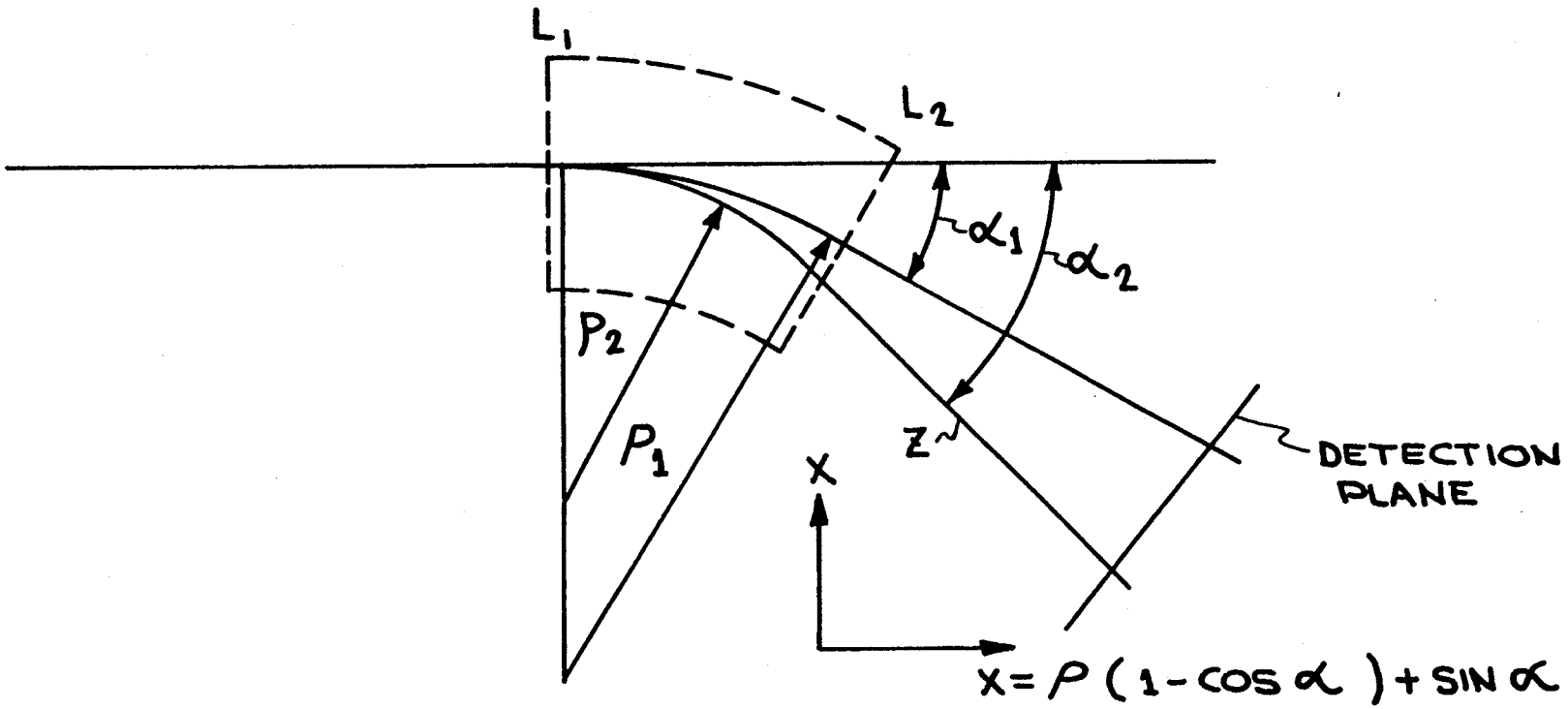
FIG. 4 is an illustration of the trajectory of a charged particle, for illustration of the measurement of the particles' energy.

In operation, a charged particle beam is directed along a direction shown by arrow 15 through a device, such as a wiggler 14 shown in FIG. 1. As shown the trajectory of the charged particles in the charged particle beam is along the direction shown by arrow 15, which is parallel to the plane of the page of FIG. 1. A bending magnet 20 is used to create a magnetic field along part of the path of the charged particle beam. The magnetic field is perpendicular to the plane of the page of FIG. 1. Since the charged particles are electrons in this example, and are therefore negatively charged, the magnetic field lines of the dipole magnet 20 are in the direction into and perpendicular to the plane of the page of FIG. 1. The trajectory of the charged particles is changed by the magnetic field. FIG. 4 illustrates how the trajectory of a charged particle beam is changed when passed through the magnetic field of the magnet 20 to allow the inventive apparatus to measure the energy of particles of a known mass and charge. In accordance to known physics principals, for a given magnetic field B, a charged particle having energy E and rest energy $E_o$ will be deflected in a circular arc having a bend radius $\rho$ shown in FIG. 4, given by $$\rho=(K_1\beta/B)\gamma$$

Where $K_1$ is a constant based on the charge of each particle and the rest mass $m_o$ of each particle by the equation $K_1=m_oc/e$, wherein c is the speed of light, and e is the charge of the particle. $\gamma$ is a relativistic measurement where $\gamma=1+E/E_o$. $\beta=(1-1/\gamma^2)^{\frac{1}{2}}$. If the magnetic field begins at $L_1$, and ends at $L_2$, the particle will be bent through a total bend angle $\alpha$, given by $$\alpha = (1/B\rho) \int_{L_1}^{L_2} B \cdot dl.$$

As a result of passing a particle beam through the bending magnet 20, the single beam of charged particles has been transformed into an angularly spread particle beam or a plurality of particle beams both radiating from the magnetic field and the original particle beam trajectory in a plurality of angular directions, with the particles having the higher charge and lower kinetic energy having the sharpest bend angles and the particles having the lower charge and higher kinetic energy having the more obtuse bend angles from the original particle beam trajectory. Since the original trajectory of the charged particles is along the plane of the page of FIG. 1 and since the magnetic field lines are perpendicular to the plane of the page of FIG. 1, the resulting trajectories of the charged particles is along the plane of the page of FIG. 1.

The beam detector 26 is located with respect to the magnetic field so that the resulting spread particle beam or plurality of particle beams are directed towards the beam detector 26. As the charged particles travel through the drift tube 24 in their axial directions, the angular dispersion of the charged particles causes a spatial spread of the charged particle beam in the form of a radial spread with a linear cross-section. The particle beam or beams thus pass through the drift tube 24 to the beam detector 26. Different components of the radially spread beam or beams pass down different spread chambers 58 of the beam detector 26. Each beam detector chamber wall 44 corresponds to a precise energy value, and thus chamber 58 corresponds to a energy range, which can be calculated by using the above equations. Therefore charged particles passing through a particular chamber 58 will have a kinetic energy within a particular and determinable energy range.

Figure 5:
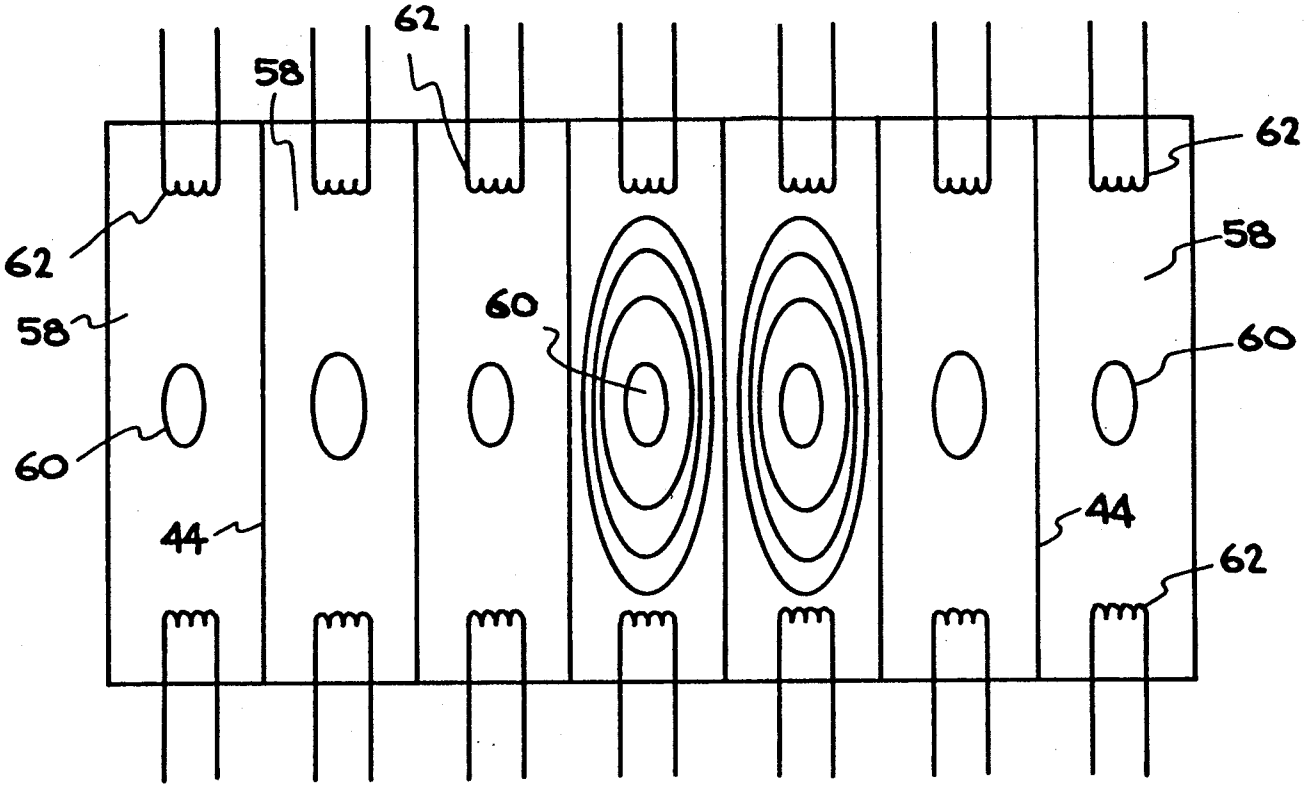
FIG. 5 is a cross-sectional and schematic view of the preferred embodiment of the invention shown in FIG. 2, along lines 5.

FIG. 5 is a cross-sectional and schematic view of the inventive beam detector along lines 5 of FIG. 2. FIG. 5 illustrates a beam current 60 in each compartment 58, with the compartments 58 being separated by the separation walls 44. In the preferred embodiment the separation walls 44 are substantially parallel to the trajectories of the particles passing near the separation walls 44. Therefore the separation walls 44 are axially aligned with the trajectories of the particles near the separation walls 44. In addition, in this embodiment, the chambers 58 are aligned in a row radially spread along the trajectories of the particle beams and therefore the row lies parallel to the plane of the page of FIG. 1.

Current detection is based on Faraday's law;

$$v(t)=-d\Phi/dt$$

Where $\Phi$ is the magnetic flux. The derivation of the total magnetic flux within the probe loop is complicated by both the presence of the ferrite within the loop, as well as the boundary conditions imposed on the field distribution due to the chamber geometry. Experiments have shown that the signal values obtained through the use of the ferrite-loaded probes, current loops with ferrite cores, are at least an order of magnitude greater than those obtained in vacuum.

Because the cross-sectional thickness of each separation wall 44 is small compared to the width of a chamber 58, only a small number of particles (therefore a low current) is intercepted by the walls 44 of the beam detector 26. The relatively small number of particles intercepting the separation walls gain a radial velocity component from collisions between the particles and the separation wall material. This relatively small number of particles intercepting the separation wall does not damage the beam detector 26, because the separation walls are so thin that the radial velocity component causes the particles to exit the sides of the separation walls before they are appreciably slowed down by the wall material and can transfer their kinetic energy to the wall material and damage the beam detector.

The signal produced by probes 62 can be treated in a number of different ways by the electronic data acquisition and display apparatus 61. In the preferred embodiment of the invention, the electronic data acquisition apparatus 61 integrates the probe 62 signal once to provide the transient current pulse, and again to give the total charge transported through the chamber. This operation is performed in real time by the electronic data acquisition and display apparatus 61. Because each pair of Faraday probes 62 is symmetrically located with respect to the beam centerline, their outputs can inversed, summed and divided to cancel noises from x-rays or other sources. The combination of magnetic field separation walls 44 and individually instrumented chambers 58 allows the invention to accurately determine not only the energy components present in the beam, but the number of particles (current) contained within each energy component. The associate electronic data acquisition and display apparatus 61 allows the measurement of current versus energy in real time and may allow the creation of a real time current verses energy particle beam histogram.

The foregoing description of preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. A spectrometer for measuring the energy or momentum distribution of a plurality of charged particles with trajectories forming a charged particle beam traveling in a first direction, the spectrometer comprising:

a bending magnet, which creates a magnetic field along the trajectories of the charged particle beam for bending trajectories of the plurality of charged particles from the first direction into a plurality of radially dispersed directions radiating from the magnetic field;

at least three adjacent tubular chambers along the trajectories of the plurality of charged particles, with walls separating the adjacent chambers and wherein the walls separating the chambers comprise a conducting material; and a plurality of Faraday probes, wherein each chamber has at least one Faraday probe located within the chamber.

2. A spectrometer as claimed in claim 1, wherein each tubular chamber has a length and an axis which runs the length of each tubular chamber, wherein the walls separating the chambers run the length of adjacent tubular chambers and wherein each tubular chamber has a first end with a first opening on the first end of the length of the tubular chamber and a second end with a second opening on the second end of the length of the tubular chamber and wherein each first end of a tubular chamber is adjacent to a first end of another tubular chamber and each second end of a tubular chamber is adjacent to a second end of a tubular chamber and wherein the axis of each tubular chamber is substantially parallel to a trajectory of a charged particle.

3. A spectrometer as claimed in claim 2, wherein each chamber has two Faraday probes.

4. A spectrometer as claimed in claim 3, wherein each Faraday probe comprises a current loop with a high permeability ferrite core in the center of the current loop, and wherein the Faraday probes are located outside of the trajectories of the charged particles so that the probes provide an output indicative of the charged particle current passing through a chamber.

5. A spectrometer as claimed in claim 3, wherein the walls separating adjacent chambers have a thickness between 0.01 mm and 100 mm and wherein the interiors of the tubular chambers have an atmospheric pressure of less than 0.5 atmospheres.

6. A spectrometer as claimed in claim 5, wherein the walls separating adjacent chambers have a thickness between 0.1 mm and 10 mm.

7. A spectrometer as claimed in claim 6, wherein each first opening lies along a plane which is substantially perpendicular to the axis of a tubular chamber and wherein each second opening lies along a plane which is substantially perpendicular to the axis of a tubular chamber and wherein the walls separating the chambers are substantially parallel to the trajectories of charged particles passing near the walls, so that a small number of charged particles collide into the walls and that very little energy is deposited by such collisions.

8. A spectrometer as claimed in claim 3, further comprising a means for electronically processing the output from the Faraday probes to provide an instantaneous energy versus current output and the cancelling out of X-ray noise, electrically connected to the Faraday probes.

9. A beam detector for instantaneously measuring a charged particle beams current and spacial distribution, comprising:

at least three adjacent tubular chambers, with walls separating the adjacent chambers and wherein the walls separating the chambers comprise a conductive material and wherein the adjacent chambers are in a row; and a plurality of Faraday probes, wherein each chamber has at least one Faraday probe located within the chamber;

10. A beam detector as claimed in claim 9, wherein each chamber has two Faraday probes.

11. A beam detector as claimed in claim 10, wherein each Faraday probe comprises a current loop with a high permeability ferrite core in the center of the current loop.

12. A beam detector as claimed in claim 11, wherein the walls separating adjacent chambers have a thickness between 0.01 mm and 100 mm and wherein the interior of the tubular chambers have an atmospheric pressure of less than 0.5 atmospheres.

13. A beam detector as claimed in claim 12, wherein the walls separating adjacent chambers have a thickness between 0.1 mm and 10 mm.

14. A beam detector as claimed in claim 13, wherein each tubular chamber has a length and an axis which runs the length of each tubular chamber, wherein the walls separating adjacent chambers run the length of adjacent tubular chambers and wherein each tubular chamber has a first end with a first opening on the first end of the length of the tubular chamber and a second end with a second opening on the second end of the length of the tubular chamber and wherein each first end of a tubular chamber is adjacent to a first end of another tubular chamber and each second end of a tubular chamber is adjacent to a second end of a tubular chamber and wherein each first opening lies along a plane which is substantially perpendicular to the axis of a tubular chamber and wherein each second opening lies along a plane which is substantially perpendicular to the axis of a tubular chamber.

15. A beam detector as claimed in claim 14, further comprising a means for electronically processing the output from the Faraday probe to provide an instantaneous axial versus current output, electrically connected to the Faraday probes.

16. A method for measuring the energy distribution for a plurality of charged particles with trajectories forming a charged particle beam, comprising the steps of:

passing the charged particles through a magnetic field with magnetic field lines substantially perpendicular to the trajectories of the charged particles, thus causing the trajectories of the charged particles to bend and angularly separate into a plurality of angularly dispersed trajectories;

passing a charged particle through only one of a plurality of chambers; and the magnetic field induced by the current passing through each individual chamber.

17. A method for measuring as claimed in claim 16, further comprising the step of isolating the magnetic field induced by the current passing through one chamber from the magnetic fields induced from currents passing through adjacent chambers.

18. A method for measuring as claimed in claim 17, wherein the means for measuring the magnetic field induced by the current passing through each individual chamber comprises the step of measuring the current induced in a current loop.

19. A method for measuring as claimed in claim 18, further comprising the step of processing the measurements of the magnetic field induced by current passing through each individual chamber to provide a current versus energy distribution histogram of the charged particle beam.

20. A method for measuring as claimed in claim 19, providing an instantaneous real time measurement of the current versus energy distribution histogram of the charged particle beam.

* * * * *